US012384590B2

(12) United States Patent
Arbab et al.

(10) Patent No.: US 12,384,590 B2
(45) Date of Patent: Aug. 12, 2025

(54) LIGHTWEIGHT BEVERAGE CAN MADE FROM ALUMINUM ALLOY

(71) Applicants: CONSTELLIUM NEUF-BRISACH, Biesheim (FR); CONSTELLIUM MUSCLE SHOALS LLC, Muscle Shoals, AL (US)

(72) Inventors: Alireza Arbab, Rives-sur-Fure (FR); Thierry Bayle, Reaumont (FR); Mircea Cablea, Sassenage (FR); Laurent Laszczyk, Grenoble (FR)

(73) Assignees: CONSTELLIUM NEUF-BRISACH, Biesheim (FR); CONSTELLIUM MUSCLE SHOALS LLC

( * ) Notice: Subject to any disclaimer, the term of this patent is extended or adjusted under 35 U.S.C. 154(b) by 374 days.

(21) Appl. No.: 17/610,666

(22) PCT Filed: May 12, 2020

(86) PCT No.: PCT/FR2020/050778
§ 371 (c)(1),
(2) Date: Nov. 11, 2021

(87) PCT Pub. No.: WO2020/229767
PCT Pub. Date: Nov. 19, 2020

(65) Prior Publication Data

US 2022/0242605 A1 Aug. 4, 2022

(30) Foreign Application Priority Data

May 13, 2019 (FR) ..... 1904973
Apr. 3, 2020 (FR) ..... 2003379

(51) Int. Cl.
*B65D 1/16* (2006.01)
*B21D 51/26* (2006.01)
*B65D 1/46* (2006.01)

(52) U.S. Cl.
CPC ..... *B65D 1/165* (2013.01); *B21D 51/26* (2013.01); *B65D 1/46* (2013.01)

(58) Field of Classification Search
CPC ..... B65D 1/165; B65D 21/0216; B65D 1/46
See application file for complete search history.

(56) References Cited

U.S. PATENT DOCUMENTS 4,412,627 A 11/1983 Houghton et al.
4,515,284 A 5/1985 Lee et al.
(Continued)

FOREIGN PATENT DOCUMENTS

EP 0302412 A2 2/1989
EP 0899199 A2 3/1999
WO 2016146362 A1 9/2016

OTHER PUBLICATIONS

International Search Report of International Patent Application No. PCT/FR2020/050778 Sep. 7, 2020.

*Primary Examiner* — Jeffrey R Allen
(74) *Attorney, Agent, or Firm* — McBee Moore & Vanik IP, LLC

(57) ABSTRACT

The invention relates to a beverage can on the basis of an aluminum alloy, preferably for a carbonated drink, comprising:

- a body (6) having a cylindrical shape and an outer diameter D1;
- a concave dome-shaped bottom (1) having a depth H1 at its center, an outer diameter D3 and a rectilinear part (2) having a height H3;
- a convex lower ring (7) having a stand diameter D2 and a flat surface with a width L2;
- an outer shoulder (5) of radius R1;
- a shime (4) connecting the outer shoulder (5) and the lower ring (7).

(Continued)

The invention is characterized in that the thickness of the sheet of the dome is from 180 to 230 μm, preferably from 190 to 220 μm;

and in that the outer diameter D3 of the concave dome (1) is from 36 to 44 mm, preferably from 37 to 43 mm;

and in that the width of the lower ring L4 is from 3 to 4.5 mm, preferably from 3.3 to 4 mm;

and in that the lower ring has concave deformations (8) which are distributed at regular intervals along the lower ring (7).

18 Claims, 7 Drawing Sheets

(56) References Cited

U.S. PATENT DOCUMENTS

| | | | | |
|---|---|---|---|---|
| 4,685,582 | A | 8/1987 | Pulciani et al. | |
| 4,732,292 | A | 3/1988 | Supik | |
| 4,953,738 | A | 9/1990 | Stirbis | |
| 5,421,480 | A * | 6/1995 | Cudzik | B65D 1/165 220/624 |
| 5,680,952 | A | 10/1997 | Curtis | |
| 7,185,525 | B2 | 3/2007 | Werth et al. | |
| 7,395,686 | B2 * | 7/2008 | Dervy | B21D 22/30 72/379.4 |
| 2008/0029523 | A1 * | 2/2008 | Tung | B65D 1/46 220/608 |

* cited by examiner

[Fig. 1]
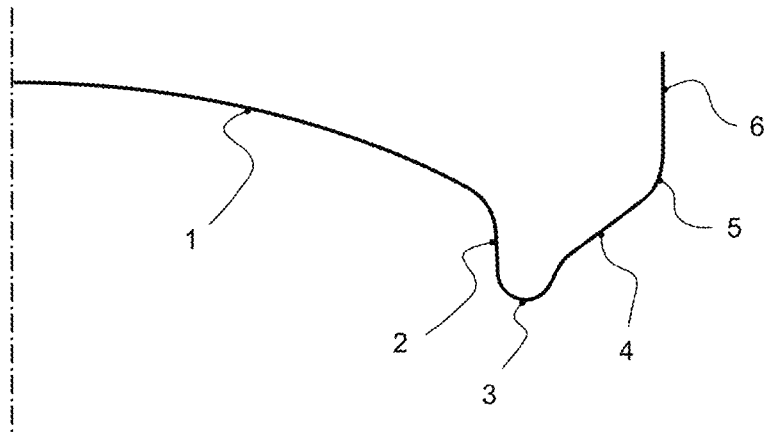
[Fig. 2]
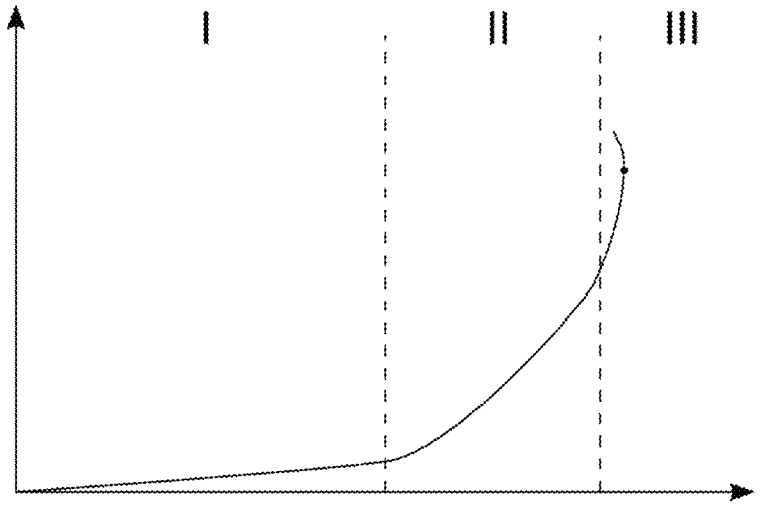

[Fig. 3]
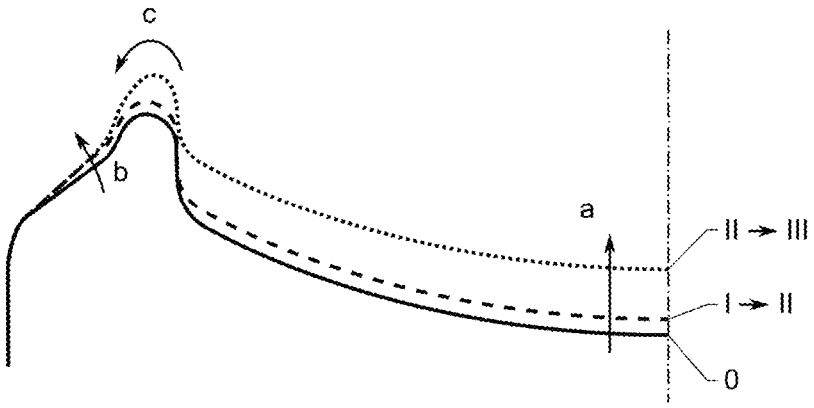
[Fig. 4]
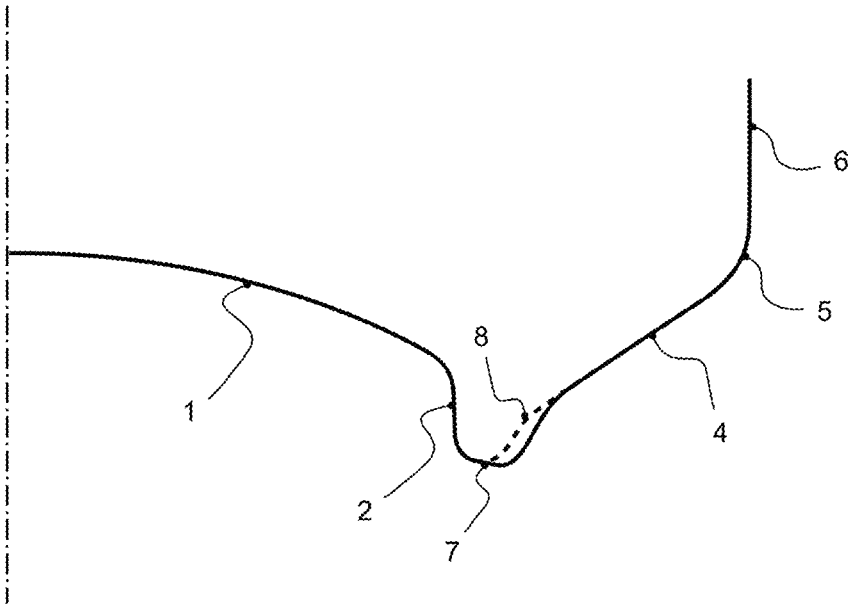

[Fig. 5]
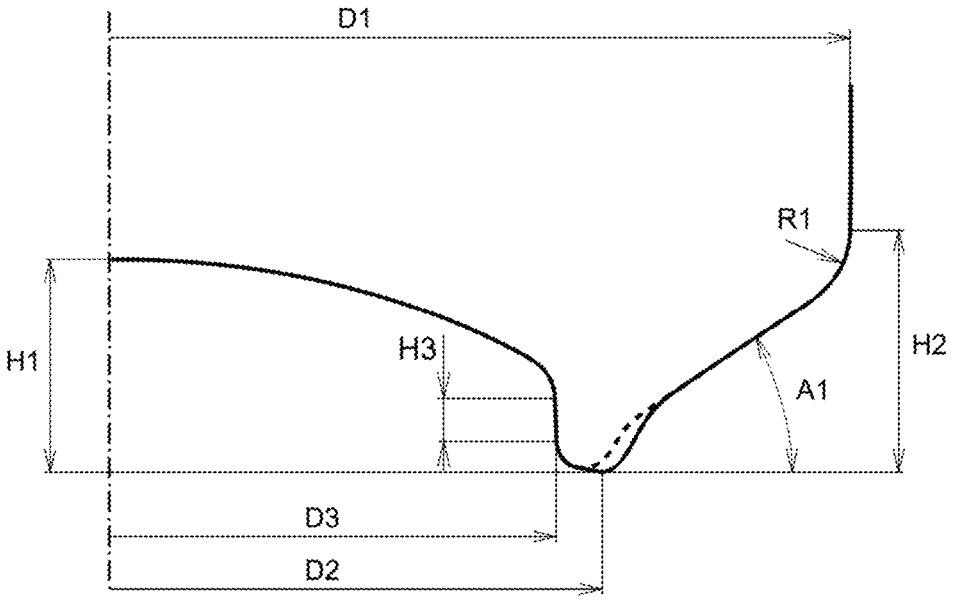
[Fig. 6]
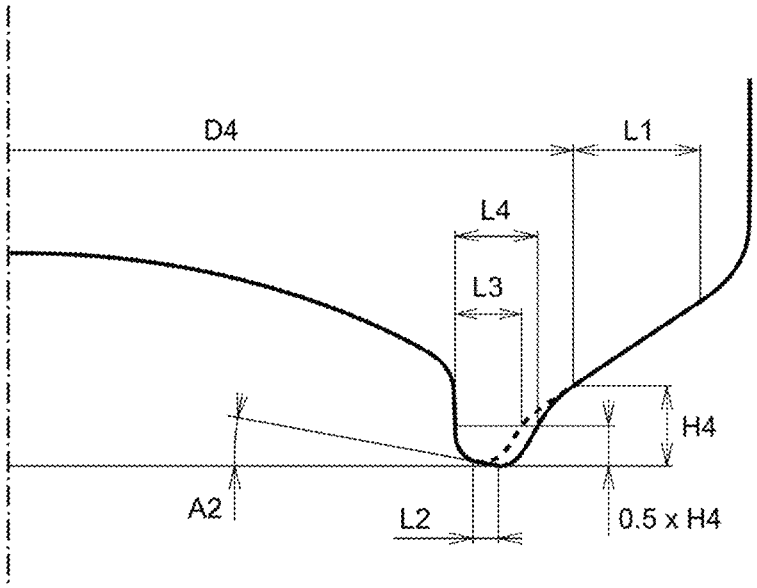

[Fig. 7]
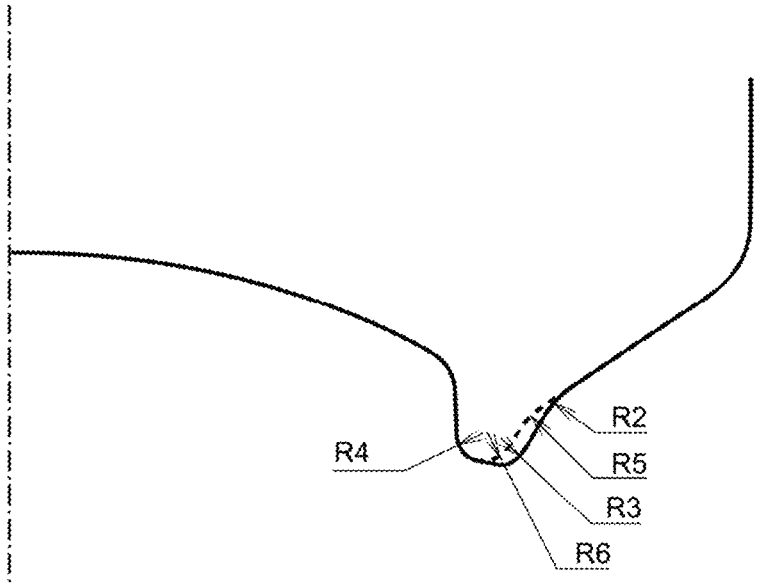
[Fig. 8]
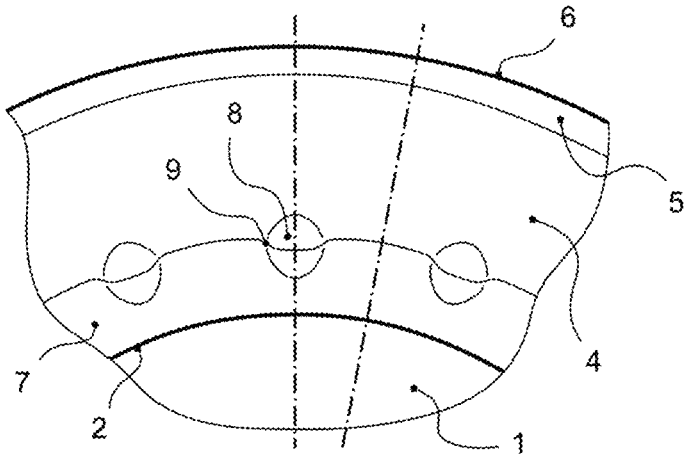

[Fig. 9]
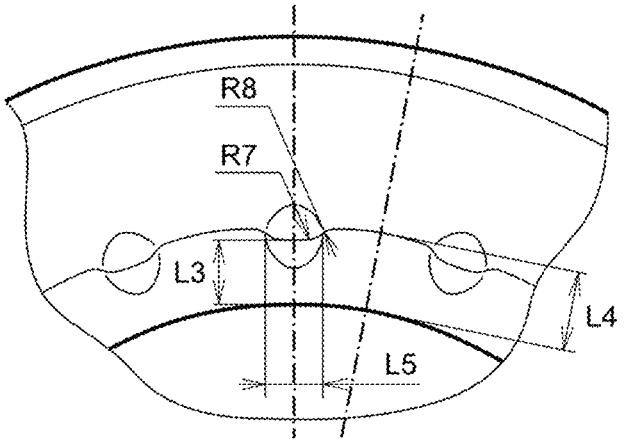
[Fig. 10]
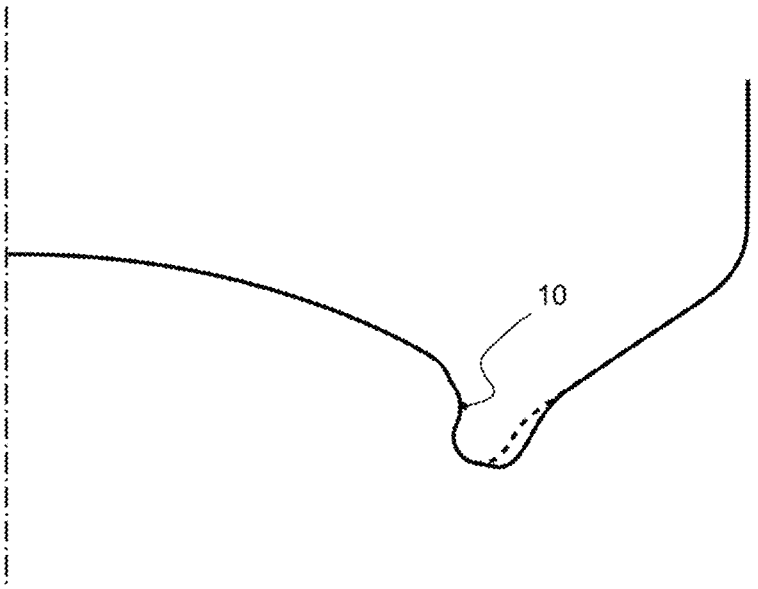

[Fig. 11]
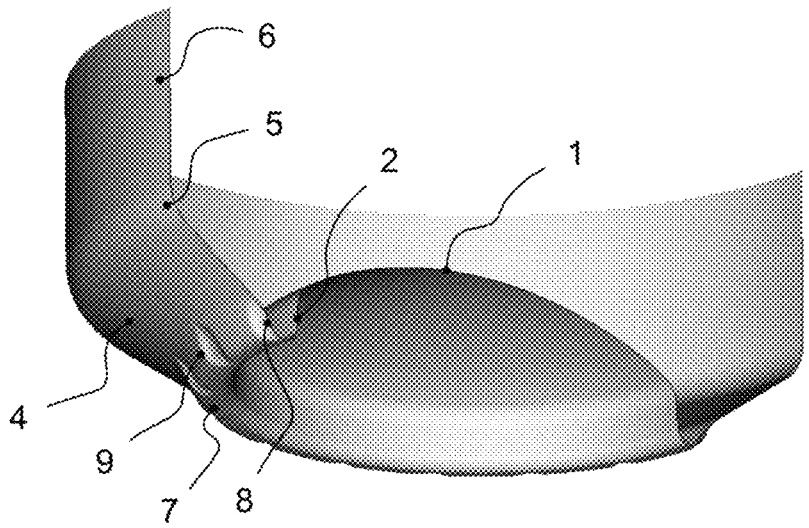
[Fig.12]
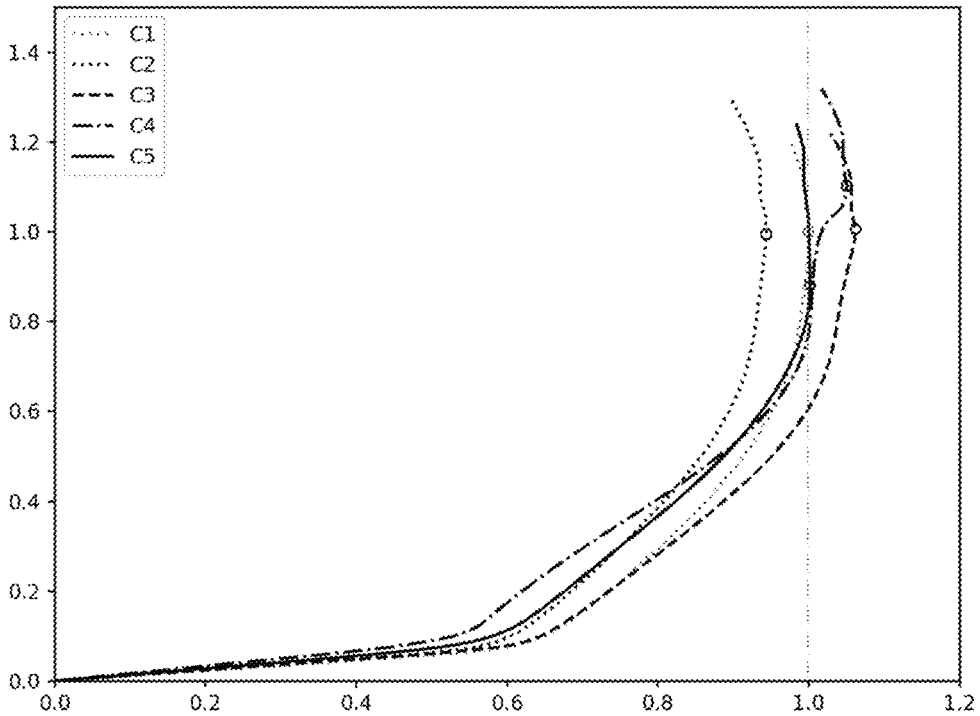

[Fig. 13]
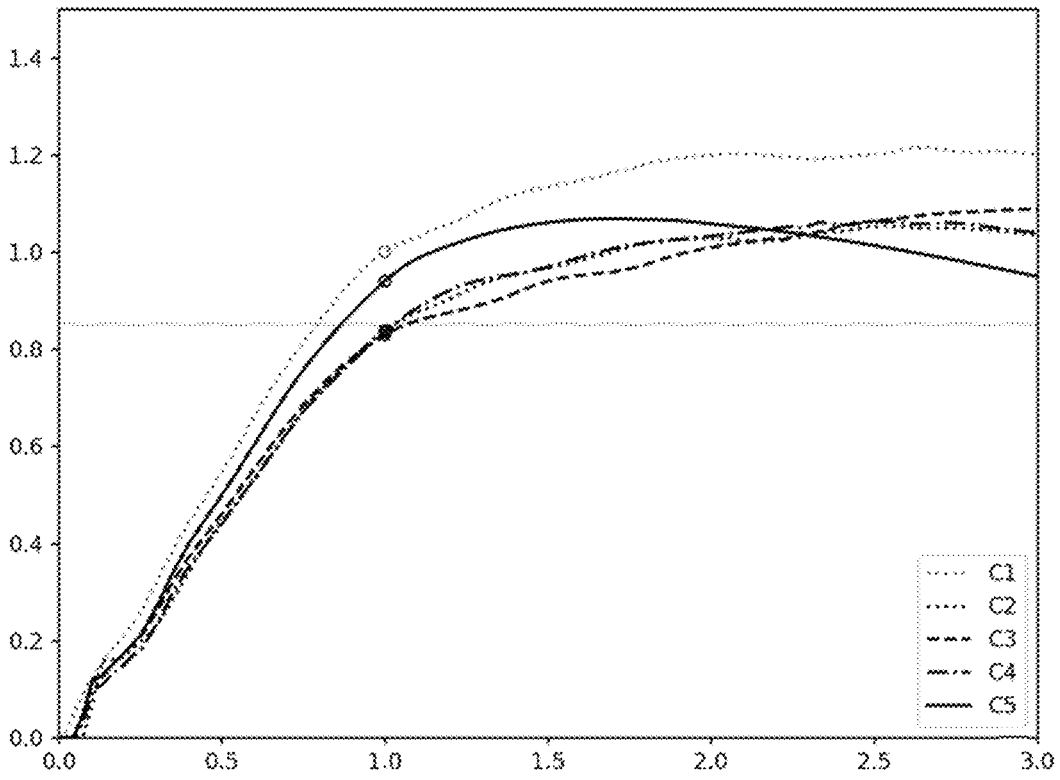

LIGHTWEIGHT BEVERAGE CAN MADE FROM ALUMINUM ALLOY

CROSS-REFERENCE TO RELATED APPLICATIONS

This application is the National Stage entry of International Application No. PCT/FR2020/050778, filed 12 May 2020, which claims priority to French Patent Application No. 1904973, filed 13 May 2019 and French Patent Application No. 2003379, filed 3 Apr. 2020.

BACKGROUND

Field

The technical field of the invention is that of beverage cans, in particular carbonated beverages, based on aluminium or aluminium alloy. FIG. 1 shows a sectional diagram of a beverage can half-bottom. Referring to FIG. 1, a beverage can generally comprises a beverage can body 6, a dome 1, a lower ring 3, a rectilinear part 2 of the dome 1 and a shime 4 connecting the lower ring and the body of the beverage can.

Description of Related Art

Provision is made of a prior art in the field of beverage cans to solve various technical problems. For example, U.S. Pat. No. 4,685,582 by National Can Corporation is known, which describes a solution for improving the compatibility between the bottom and the cover of beverage cans with the purpose of being able to stack the beverage cans easily during their transport and their storage.

U.S. Pat. No. 5,680,952 by Ball Corporation is also known, which describes a beverage can having particular dimensions, as well as deformations on the dome of the bottom of the beverage can. There are also several documents describing convex or concave deformations on the dome of the bottom of the beverage can and/or the oblique lower edge of the bottom of the beverage can. Mention may in particular be made of U.S. Pat. No. 4,953,738 by Stirbis, patent application US 2008/0029523 by Rexam Beverage Can, or else U.S. Pat. No. 7,185,525 by Elmer.

U.S. Pat. No. 4,732,292 by Schmalbach-Lubeca GmbH is also known, which describes concave deformations on the bottom of the beverage can, distributed over at least two concentric circles of different diameters.

Patent application EP 0 302 412 by Pac International Inc. is also known, which describes a particular structure for the bottom of a beverage can with a series of shelves and flat parts.

Despite all these solutions, manufacturers are constantly on the lookout for cost reductions, paying particular attention to reducing the thickness of the metal alloy used for the manufacture of beverage cans. This reduction in thickness raises many problems, which can be, for example, the shaping and mechanical resistance of the beverage can (axial resistance, resistance to internal pressure, resistance to falling, etc.).

Resistance to internal pressure, which is one of the main properties sought, can be characterised by a test consisting of increasing the internal pressure (=pressure inside the beverage can). This test allows to identify two values known to the person skilled in the art: the overturning pressure, which corresponds to the maximum pressure observed when the dome is overturned, and the increase in the height of the beverage can after a typical pressure cycle (increase from 0 to 6.2 bar, then decrease to 3.5 bar). This increase in beverage can height corresponds to the residual deformation caused by the increase in pressure and which persists even after the decrease in internal pressure. As illustrated in the examples below (see FIGS. 12 and 13), the inventors propose two curves representing the increase in the height of the beverage can (measured at the lower ring) as a function of the internal pressure for the purpose of determining these two values and understanding the associated physical phenomena.

A theoretical example of such a curve is given in FIG. 2 of this description. This curve can be described by three stages I, II and III corresponding to distinct deformation mechanisms of the beverage can a, b and c, as illustrated in FIG. 3 of the present description. A first linear stage, called stage I on the curve of FIG. 2, corresponds to an elastic deformation characterised by a slight swelling of the dome and a rotation of the oblique edge (respectively a and b of FIG. 3). At this stage, if the internal pressure is removed, the dome and the oblique edge can return to the initial position. This stage I is not very sensitive to the reduction in thickness of the bottom of the beverage can.

A second linear stage, called stage II on the curve in FIG. 2, corresponds to a start of plastic deformation of the dome (a in FIG. 3) characterised by the irreversible unfolding of the radius of the lower ring (c in FIG. 3), as well as an amplified swelling of the dome. At this stage, if the pressure is removed, the dome no longer returns to its initial position and a residual deformation of the lower ring remains. This stage II is sensitive to the reduction in thickness of the bottom of the beverage can: the resulting deformation of the pressure increases as the thickness decreases, which limits the possibilities of reducing the thickness.

Finally a third stage, called stage III on the curve of FIG. 2, corresponds to a dramatic and irreversible deformation of the dome, that is to say that at this stage a minimal amount of additional pressure compared to stage II leads to a very significant deformation of the dome, of the oblique edge and of the lower ring (respectively a, b and c in FIG. 3) which persists even after reduction in pressure. The thickness of the initial sheet, which is changed very little during the shaping of the dome of the beverage can with a thinning of the order of 2 to 5%, and which therefore corresponds approximately to the thickness of the sheet of the dome, is chosen such that the overturning pressure is greater than the maximum internal pressure observed during the production, transport or storage of beverage cans, typically 90 pound-force per square inch (psi) (which is approximately 6.2 bars).

The axial resistance, which is another of the main properties sought, can be characterised by a test consisting in applying a vertical force downwards on the upper end of the beverage can, which is empty and without a cover, when the latter is placed vertically on a flat surface. The geometry of the bottom of the beverage can as well as the thickness of the sheet are chosen such that the location of the dramatic and irreversible deformation during the increase in the applied vertical force, characterised by an inflection of the force versus displacement curve, always takes place at the body of the beverage can and for a force greater than the values observed during the production, transport or storage of the beverage cans, namely generally 200 pounds (lbs) (which is approximately 900 Newton (N)).

SUMMARY

In this context of reducing the thickness of the initial aluminium alloy sheet used for the manufacture of beverage cans put into perspective with the resistance to internal pressure, the inventors have developed a beverage can capable of maintaining, or even improving the resistance to internal pressure, despite the reduction in thickness of the initial aluminium alloy sheet.

Currently, initial aluminium alloy sheet thicknesses for beverage cans are generally around 260 μm in the United States and around 245 μm in Europe. The initial aluminium alloy sheet thicknesses targeted according to the present invention are of the order of 200 to 230 μm, which is approximately 6 to 18% reduction in thickness in Europe and approximately 11 to 23% in the United States.

The technical problem solved according to the present invention is therefore to reduce the thickness of the initial aluminium alloy sheet used for the manufacture of beverage cans, for example by 5 to 25% compared to what is usually practiced in the field of beverage cans (approximately 15 to 60 μm reduction), while improving the resistance to internal pressure compared to a conventional beverage can obtained from a thinned sheet and while maintaining the resistance to internal pressure compared to a conventional commercial beverage can, and while retaining satisfactory axial resistance (to vertical force).

It should be noted that the reduction in thickness of the initial aluminium alloy sheet used for the manufacture of beverage cans ultimately allows to lighten the beverage cans by 2 to 15%, knowing that the bottom of the beverage can, which retains the initial thickness of the aluminium alloy sheet, generally represents more than 30% of the total weight of the beverage can.

In addition to resistance to internal pressure, the person skilled in the art also faces problems of resistance to vertical stress during the manufacture and filling of beverage cans, as well as the crimping of the cover. It should be noted that the present invention, which allows to limit the deformations undergone by the cans during their life cycle due to the internal pressure, also has the advantage of maintaining a resistance to the vertical force with respect to a conventional commercial beverage can.

A first object of the invention is a beverage can based on an aluminium alloy, preferably for a carbonated beverage, comprising (see FIGS. 4 to 11):

- a body 6 of cylindrical shape having an outer diameter D1;
- a bottom in the shape of a concave dome 1 having a depth H1 at its centre, an outer diameter D3 and a rectilinear part 2 of height H3;
- a convex lower ring 7 having a stand diameter D2 and a flat surface of width L2;
- an outer shoulder 5 having a radius R1;
- a shime 4 connecting the outer shoulder 5 and the lower ring 7;
- characterised in that the thickness of the dome sheet is 180 to 230 μm, preferably 190 to 220 μm;
- and in that the outer diameter D3 of the concave dome 1 is 36 to 44 mm, preferably 37 to 43 mm;
- and in that the width of the lower ring L4 is 3 to 4.5 mm, preferably 3.3 to 4 mm; and in that the lower ring comprises concave deformations 8, distributed at regular intervals along the lower ring 7.

A second object of the invention is a method for manufacturing a beverage can according to the present invention, comprising the following successive steps:

- providing an aluminium alloy, for example AA3104, for example in the metallurgical state H14 or H19, in the shape of a strip with a thickness of 180 to 230 μm, preferably 190 to 220 μm;
- cutting discs called blanks in the aluminium alloy strip;
- stamping and stretching the blanks to obtain a beverage can body, using tools adapted to form the beverage can as described in the present application;
- making a cover with another aluminium alloy, for example AA5182;
- assembling the cover and the body of the beverage can to obtain a beverage can.

A third object of the invention is a tool for shaping the beverage can according to the present invention.

BRIEF DESCRIPTION OF THE DRAWINGS

FIG. 1 is a sectional diagram of a beverage can half-bottom. Reference 1 corresponds to the dome of the beverage can, reference 2 to the rectilinear part of the dome, reference 3 to the lower ring, reference 4 to the oblique edge of the bottom of the beverage can, called shime, reference 5 to the outer shoulder of the body of the beverage can and the reference 6 to the body of the beverage can.

FIG. 2 is a theoretical curve illustrating the increase in the height of the beverage can, measured at the lower ring, as a function of the internal pressure, that is to say the pressure inside the beverage can. Reference I corresponds to a stage of reversible deformation, reference II to a stage of non-reversible deformation, which could adversely affect the filling, stability or stackability of the beverage can, and reference III to a stage where the dome turns over. In stage III, the beverage can is then no longer stable, that is to say it can no longer stand upright, and it is no longer stackable.

FIG. 3 is a cross-sectional diagram of a beverage can half-bottom illustrating the different stages of deformation as a function of the increase in internal pressure. The solid line (stage 0) corresponds to the undeformed beverage can. The dashed line corresponds to the limits of the bottom of the beverage can when transitioning from stage I to stage II in FIG. 2. The dotted line corresponds to the limits of the bottom of the beverage can when transitioning from stage II to stage III in FIG. 2. The reference "a" corresponds to the deformation of the dome, the reference "b" to the deformation of the oblique edge, and the reference "c" to the deformation of the lower ring.

FIG. 4 is a sectional diagram of a beverage can half-bottom according to the present invention, and in particular according to Example 1 below. In this figure, the references 1, 2, 4, 5 and 6 are the same as those described in connection with FIG. 1 above. Reference 7 corresponds to the lower ring according to the present invention and reference 8 to a concave deformation of the lower ring (for example a rib).

FIG. 5 is a sectional diagram of a beverage can half-bottom according to the present invention, and in particular according to Example 1 below. In this figure, the reference D1 corresponds to the outer diameter of the beverage can, D2 to the stand diameter of the lower ring, on the outermost bearing point relative to the central axis of the dome, D3 to the outer diameter of the dome (=diameter of the rectilinear part of the dome), H1 to the depth of the dome, H2 to the height of the shime, H3 to the height of the rectilinear part of the dome, A1 to the angle of the rectilinear section of the shime relative to the horizontal, and R1 to the radius of the outer shoulder 5, which is convex, located in the connecting portion between the body 6 of the beverage can and the shime 4.

FIG. 6 is a sectional diagram of a beverage can half-bottom according to the present invention, and in particular according to Example 1 below. In this figure, the reference D4 corresponds to the diameter of the beginning of the rectilinear section of the shime, H4 to the height of the beginning of the rectilinear section of the shime, L1 to the width of the rectilinear section of the shime, A2 to the angle of the flat surface of the lower ring relative to the horizontal, L2 to the length of the flat surface of the lower ring, L3 to the minimum width of the lower ring within a concave deformation, and L4 to the width of the lower ring excluding the concave deformations. The widths L3 and L4 are defined at a height equal to half the height H4.

FIG. 7 is a sectional diagram of a beverage can half-bottom according to the present invention, and in particular according to Example 1 below. In this figure, the reference R2 corresponds to the concave radius, located in the connecting portion between the shime and the lower ring, excluding the concave deformations, before the radii R3 and R4 described below, R3 to the convex radius, located in the connecting portion between the shime and the lower ring, excluding the concave deformations, between the radii R2 described above and R4 described below, R4 to the convex radius, located in the connecting portion between the lower ring and the rectilinear part of the dome, after the radii R2 and R3 described above, R5 to the concave radius, located in the connecting portion between the shime and the lower ring, within the concave deformations, before the radii R6 described below and R4 described above, and R6 to the convex radius, located in the connecting portion between the shime and the lower ring, within the concave deformations, between the radii R5 and R4 described above.

FIG. 8 is a diagram of a concave deformation viewed from below. In this figure, the references 1, 2, 4, 5 and 6 are the same as those described in connection with FIG. 1 above. References 7 and 8 are the same as those described in connection with FIG. 4 above. Reference 9 corresponds to the curved section of the connection area between the interior of a concave deformation and an area without concave deformation, along a horizontal section at a height equal to half the height H4.

FIG. 9 is a diagram of a concave deformation seen from below. In this figure, the reference L5 corresponds to the length of the concave deformation 8, R7 to the concave radius of the curved section 9, and R8 to the convex radius of the curved section 9. The references L3 and L4 are the same as those described in connection with FIG. 6 above.

FIG. 10 is a sectional diagram of a beverage can half-bottom according to the present invention, and in particular according to Example 1 below. In this example, an additional shaping operation for reforming the dome was applied, as currently practiced on a number of commercial beverage can formats, and so that the rectilinear part of the dome 2 is transformed with an axisymmetric concave deformation 10.

FIG. 11 is a three-dimensional diagram of a cross section of a beverage can bottom according to the present invention, and in particular according to Example 1 below. In this figure, the references 1, 2 and 4 to 9 are the same as those described in connection with FIG. 8 above.

FIG. 12 is a curve showing the increase in height of the beverage can (generally expressed in mm), measured at the highest point when the beverage can is positioned upside down, that is to say when the dome is up, as a function of the internal pressure (generally expressed in bars), that is to say the pressure inside the beverage can. It illustrates the results of numerical simulations for calculating the overturning pressure for several beverage cans, as explained in the examples below. The abscissa axis is not expressed in bars but in standardised values, the value 1 corresponding to the value of the overturning pressure of the reference preform C1, which is the purpose that the present invention seeks to achieve at least at 100%. This target is represented by the grey vertical line. The ordinate axis is not expressed in mm but in standardised values, the value 1 corresponding to the can height of the reference preform C1 when it is overturned.

FIG. 13 is a curve showing the increase in vertical force (usually expressed in newtons (N)), applied to the upper part of the beverage can during the axial strength test, as a function of the vertical displacement (usually expressed in mm). It illustrates the results of numerical simulations of calculation of the axial resistance of the bottom, corresponding to the inflection point of the curve, characterising the end of the linear section. The abscissa and ordinate axes are not expressed in mm and in N respectively, but in standardised values, the values 1 corresponding to the vertical displacement and vertical force values representing the axial resistance of the reference beverage can C1. The grey horizontal line corresponds to the value of 900 N (200 lbs) discussed above in the description, which is the objective that the present invention seeks to exceed.

DETAILED DESCRIPTION OF THE INVENTION

In the description, unless otherwise indicated:

- the designation of aluminium alloys conforms to the nomenclature established by The Aluminum Association;
- the contents of chemical elements are indicated in % and represent mass fractions, unless otherwise indicated.

According to the present invention, the term "convex" means oriented outwardly of the beverage can.

According to the present invention, the term "concave" means oriented inwardly of the beverage can.

The beverage can according to the present invention allows to compensate for the loss of resistance to internal pressure due to a decrease in the thickness of the aluminium alloy sheet from which the beverage can is made.

In general, with current methods, the maximum internal pressure that a beverage can undergoes during its manufacturing and life cycle is considered to be approximately 6.2 bar (90 psi). Also, it is desirable for the overturning pressure to be greater than 6.2 bars, that is to say of the same order of magnitude as that of the reference beverage can (C1 in the examples below) existing on the market. The overturning pressure is the pressure at which the dome of the bottom of the beverage can is overturned. This overturn is irreversible and prevents the stability and stacking of the beverage cans on top of each other.

In addition to the resistance to internal pressure, a beverage can is also preferably resistant to the axial loading (vertical force) which occurs during the various shaping operations of the shrinkage and the vertical section of the dome, as well as during filling and crimping of the cover. It is considered, with the current methods, that the beverage can body must withstand an axial force (vertical force) greater than approximately 900 N (that is to say 200 lbs), without having any damage to the bottom of the beverage can, or to the side wall. It is generally considered that this value of 900 N represents approximately 85% of the resistance of the reference beverage can (C1 in the examples below) existing on the market.

The beverage can according to the present invention compensates for the loss of strength due to the decrease in thickness of the aluminium alloy sheet from which the beverage can is made. In general, the beverage can according to the present invention allows to limit the deformation of the bottom of the beverage can, and in particular of the dome, of the lower ring and the shime, in stage II and to push stage III (dramatic deformation) to pressure levels higher than those requested by customers, generally 6.2 bars.

The solution proposed according to the present invention comprises the combination of three features having a synergistic effect:

reduction of the outer diameter of the dome;

increase in the width of the lower ring;

addition of concave deformations (for example notches or ribs) at the lower ring.

A first object according to the present invention is a beverage can based on an aluminium alloy, preferably for a carbonated beverage, comprising:

a body 6 of cylindrical shape having an outer diameter D1;

a bottom in the shape of a concave dome 1 having a depth H1 at its centre, an outer diameter D3 and a rectilinear part 2 of height H3;

a convex lower ring 7 having a stand diameter D2 and a flat surface of width L2;

an outer shoulder 5 having a radius R1;

a shime 4 connecting the outer shoulder 5 and the lower ring 7;

characterised in that the thickness of the dome sheet is 180 to 230 μm, preferably 190 to 220 μm;

and in that the outer diameter D3 of the concave dome 1 is 36 to 44 mm, preferably 37 to 43 mm;

and in that the width of the lower ring L4 is 3 to 4.5 mm, preferably 3.3 to 4 mm; and in that the lower ring comprises concave deformations 8, distributed at regular intervals along the lower ring 7.

Preferably, the outer diameter D1 of the body 5 of the beverage can according to the present invention is 50 to 75 mm, preferably 55 to 70 mm.

Preferably, the radius R1 of the shoulder is 2 to 5 mm.

Preferably, the dome 1 of the beverage can according to the present invention has at least one of the following features:

a diameter D2 of the lower ring 3 is 39 to 47 mm, preferably 40 to 46 mm;

a depth H1 of 7 to 12 mm, preferably 8 to 11 mm; and/or a rectilinear part 2 of height H3 from 0 to 6 mm, preferably from 1.5 to 4 mm.

Preferably, the lower ring 7 of the beverage can according to the present invention has at least one of the following features:

a width L4 of 3 to 4.5 mm, preferably 3.3 to 4 mm;

a flat surface forming an angle A2 with the horizontal in the direction of the axis of symmetry of the beverage can from 0 to 10°; and/or a flat surface having a length L2 of 0 to 2 mm.

Regarding the lower ring, its geometry (for example its shape and diameter) can be optimised to improve performance depending on the intended applications. Likewise, the dimensions (for example height, width, radii of curvature) of the lower ring can also be optimised.

Preferably, the shime 4 of the beverage can according to the present invention has at least one of the following features:

a height H2 of 5 to 20 mm, preferably 6 to 14 mm;

a diameter D4 at the beginning of the rectilinear section of 42 to 53 mm;

a height H4 at the beginning of the rectilinear section of 1.5 to 4 mm, preferably 1.5 to 3.5 mm;

an angle A1 of the rectilinear section relative to the horizontal of 30 to 40°; and/or a length L1 of the rectilinear section from 0 to 13.5 mm.

Preferably, the connecting portion between the shime 4 and the lower ring 7 comprises at least one of:

a radius R2 of 2 to 4 mm; and/or a radius R3 of 1 to 3 mm.

Preferably, the connecting portion between the lower ring 7 and the rectilinear part 2 of the dome 1 comprises a radius R4 of 1 to 3 mm.

Preferably, the concave deformations 8 of the beverage can according to the present invention have at least one of the following features:

a width L3 of 2 to 4.5 mm, preferably 2.5 to 3.5 mm;

a length L5 of 1 to 10 mm, preferably 1 to 5 mm;

a radius R5 of 2 to 4 mm;

a radius R6 of 1 to 3 mm;

a length L5 of 1 to 10 mm;

a radius R7 of 0.5 to 4 mm;

a radius R8 of 0.5 to 20 mm; and/or a number N from 4 to 36, preferably from 6 to 24.

As regards the concave deformations, their shape and their number can be optimised according to the intended applications in order to gain in performance. In particular, the concave deformations extend generally and preferably beyond the lower ring in the connecting portion between the rectilinear section of the shime and the lower ring.

According to a common practice, the beverage can according to the present invention can, in certain cases, be subjected to a subsequent operation of reforming the dome, as described in FIG. 10. This modification of the profile of the bottom of the beverage can is generally carried out, on current beverage cans on the market, after application and curing of the varnishes, just like the shrinking operation in the upper part of the beverage can. It has a positive effect on the resistance to internal pressure, regardless of the features of the proposed solution.

A second object of the invention is a method for manufacturing a beverage can according to the present invention, comprising the following successive steps:

providing an aluminium alloy, for example AA3104, for example in the metallurgical state H14 or H19, in the shape of a strip with a thickness of 180 to 230 μm, preferably 190 to 220 μm;

cutting discs called blanks in the aluminium alloy strip;

stamping and stretching the blanks to obtain a beverage can body, using tools adapted to form the beverage can as described in the present application;

making a cover with another aluminium alloy, for example AA5182;

assembling the cover and the body of the beverage can to obtain a beverage can.

A third object of the invention is a tool for shaping the beverage can according to the present invention.

As regards the manufacture of the beverage can according to the present invention, the person skilled in the art will know how to adapt the tools and parameters for shaping the bottom of the beverage can according to the present invention.

The metal used for the manufacture of beverage cans can be any aluminium alloy known to the person skilled in the art suitable for this application. For example, an AA3104 type alloy can be used. The metallurgical state of the aluminium alloy can be adapted depending on the particular application. For example, the metallurgical state can be H14, H16 or H19, as described in standard EN515 (June 1993).

EXAMPLES

For the purpose of illustrating the present invention, several preforms beverage cans were evaluated for their overturning pressure and their can height increase as a function of internal pressure. The preforms correspond to the beverage can just after the initial shaping of the bottom, without taking into account the subsequent steps of reforming the dome. The metal of the beverage cans was AA3104 aluminium alloy in an H19 metallurgical state.

To determine the overturning pressure, the height of the beverage can, measured from the base of the lower ring to the top of the beverage can must be monitored according to the internal pressure. These measurements allow to plot a curve such as that shown in FIG. 12. In this figure, the reference C1 corresponds to a reference beverage can having a conventional geometry as illustrated in FIG. 1 and a dome sheet thickness of 240 μm. The reference C2 corresponds to a reference beverage can having a conventional geometry as illustrated in FIG. 1 but with a dome sheet thickness of 220 μm. The stand diameter of C1 and C2 is 57 mm. The reference C3 corresponds to the beverage can C2 but with a stand diameter of 43 mm, a height H1 of 9.35 mm so as to avoid breaking in the rectilinear part 2 of the dome during shaping, and a height H2 of 10.5 mm so that the angle A1 is kept identical to that of C1. The reference C4 corresponds to the beverage can C3 but with a width L4 of the lower ring of 3.7 mm. The references C1 to C4 are not in accordance with the present invention. The beverage can C5 is in accordance with the present invention and corresponds to the beverage can C4 but with N=18 concave deformations (ribs) distributed along the lower ring and a lower ring comprising a flat surface.

Table 1 below gives the different features of the beverage can C5.

TABLE 1

| Id | unit | Name | Example 1 (C5) |
|---|---|---|---|
| A1 | ° | Angle of the straight section of the shime | 34 |
| A2 | ° | Angle of the flat surface of the bottom ring | 0 |
| D1 | mm | Outer diameter of the beverage can | 66 |
| D2 | mm | Stand diameter of the lower ring | 43 |
| D3 | mm | Outer diameter of the dome | 39.6 |
| D4 | mm | Diameter of the beginning of the rectilinear section of the shime | 49.4 |
| H1 | mm | Depth of the dome | 9.35 |
| H2 | mm | Height of the shime | 10.5 |
| H3 | mm | Height of the rectilinear part of the dome | 2 |
| H4 | mm | Height of the beginning of the rectilinear section of the shime | 3.2 |
| L1 | mm | Length of the straight section of the shime | 6.5 |
| L2 | mm | Length of the flat surface of the ring | 0.7 |
| L3 | mm | Min width of the lower ring at a concave deformation | 3.1 |
| L4 | mm | Width of the lower ring excluding concave deformations | 3.7 |
| L5 | mm | Length of a concave deformation | 2.4 |
| N | | Number of concave deformations | 18 |
| R1 | mm | Radius of the outer shoulder | 3.7 |
| R2 | mm | First radius between shime and lower ring excluding concave deformation | 3 |
| R3 | mm | Second radius between shime and lower ring excluding concave deformation | 1.75 |
| R4 | mm | Radius between lower ring and rectilinear part of the dome | 1.5 |
| R5 | mm | First radius between shime and lower ring at a concave deformation | 2.9 |
| R6 | mm | Second radius between shime and lower ring at a concave deformation | 1.75 |
| R7 | mm | Inner radius of a concave deformation | 1.2 |
| R8 | mm | Outer radius of a concave deformation | 0.9 |

The evaluation of the overturning pressure and of the increase in the height of the can as a function of the internal pressure was carried out using finite element digital modelling with the commercial software "LS-Dyna", version 10.1, developed by the company Livermore Software Technology Corporation. The modelling consisted of first drawing the three-dimensional shape of the different beverage can bottoms in Computer Aided Design. The three-dimensional geometries have been discretised according to a sufficiently fine finite element mesh so that it is possible to precisely simulate its mechanical behaviour. The boundary conditions were applied to simulate the behaviour of the preform as a whole during internal pressure resistance and axial force resistance tests.

Regarding the test of resistance to internal pressure, the calculation was controlled with a constant gas flow increment, allowing to simulate:

the resulting internal pressure, and the displacement of the various points of the bottom under this internal pressure.

By combining these two variables, it was possible to plot the curves, for each of the cans tested, giving the increase in the height of the beverage can as a function of the internal pressure, normalised respectively by the pressure and the height of the beverage can when the reference C1 is overturned. FIG. 12 corresponds to a monotonic increase in internal pressure, until the dome turns over.

Regarding the test of resistance to the axial force, the calculation was controlled with an increment of vertical displacement of the upper end of the can body, allowing to simulate:

the resulting axial force, and the displacement of the various points of the bottom under this axial force.

By combining these two variables, it was possible to plot the curves, for each of the cans tested, giving the resulting axial force on the upper end of the beverage can as a function of the applied displacement, normalised respectively by the force and the displacement during the inflection of the curve of the reference C1. FIG. 13 corresponds to a monotonic increase in displacement, up to the inflection of the curve then the collapse of the bottom at maximum force.

The results obtained in terms of the beverage can overturning pressure and the inflection of the curve of the axial force as a function of the axial displacement, characterising the resistance to the axial force of the beverage can bottom, are given in FIGS. 12 and 13 and in Table 2 below.

TABLE 2

| | Features | Normalised overturning pressure compared to C1 | Normalised resistance to axial force compared to C1 |
|---|---|---|---|
| C1 | Reference bearing Diam. 57 mm (sheet thickness 240 μm) | 1 | 1 |
| C2 | Reference bearing Diam. 57 mm (sheet thickness 220 μm) | 0.94 | 0.84 |
| C3 | Bearing Diam. 43 mm (sheet thickness 220 μm) | 1.06 | 0.83 |
| C4 | Bearing Diam. 43 mm + enlarged lower ring (sheet thickness 220 μm) | 1.05 | 0.83 |
| C5 | Example 1 (sheet thickness 220 μm) | 1 | 0.94 |

According to the curves of FIGS. 12 and 13 and Table 2 above, the beverage can according to the present invention allows to counterbalance the negative effects of a reduction in thickness of the initial sheet and therefore of the sheet of the dome (beverage can C2) on the overturning pressure and the axial resistance of the beverage can, and to find a good compromise compared to the values obtained with the reference beverage can C1, namely of the same order of magnitude for the resistance to the internal pressure and more than 85% of the axial resistance. It should be noted that FIGS. 12 and 13 illustrate the synergistic effect of the combination between the decrease in the diameter of the lower ring, the widening of the lower ring and the presence of concave deformations in the lower ring. Indeed, a satisfactory compromise between overturning pressure and resistance to axial force can only be obtained by combining the three features together. The combination of only two elements together is not enough (see curves C4).

The invention claimed is:

1. A beverage can comprising an aluminium alloy, optionally for a carbonated beverage, comprising:

a body of cylindrical shape having an outer diameter D1;

a bottom in a shape of a concave dome having a depth H1 at a centre thereof, an outer diameter D3 and a rectilinear part of height H3;

a convex lower ring having a stand diameter D2 and a flat surface of width L2, wherein the diameter D2 of the lower ring is 39 to 47 mm;

an outer shoulder having a radius R1;

a shime connecting outer shoulder and the lower ring;

wherein a thickness of a dome sheet is 180 to 230 μm;

and wherein the outer diameter D3 of the concave dome is 36 to 44 mm;

and wherein a width of a lower ring L4 is 3 to 4.5 mm; and wherein the lower ring comprises one or more concave deformations, distributed at regular intervals along the lower ring.

2. The beverage can according to claim 1, wherein the outer diameter D1 of the body of the beverage can is 50 to 75 mm.

3. The beverage can according to claim 1, wherein the dome has at least one of the following features:

a depth H1 of 7 to 12 mm; and/or a rectilinear part of height H3 from 0 to 6 mm.

4. The beverage can according to claim 1, wherein the lower ring has at least one of the following features:

a flat surface forming an angle with the horizontal in the direction of the axis of symmetry of the beverage can from 0 to 10°; and/or a flat surface having a length L2 of 0 to 2 mm.

5. The beverage can according to claim 1, wherein the shime has at least one of the following features:

a height H2 of 5 to 20 mm;

a rectilinear section forming an angle with the horizontal of 30 to 40°;

a diameter D4 at the beginning of the rectilinear section of 42 to 53 mm;

a height H4 of the beginning of the rectilinear section of 1.5 to 4 mm; and/or a length L1 of the rectilinear section from 0 to 13.5 mm.

6. The beverage can according to claim 1, wherein a connecting portion between the shime and the lower ring comprises at least one of:

a radius R2 of 2 to 4 mm; and/or a radius R3 of 1 to 3 mm.

7. The beverage can according to claim 1, wherein a connecting portion between the lower ring and the rectilinear part of the dome comprises a radius R4 of 1 to 3 mm.

8. The beverage can according to claim 1, wherein the one or more concave deformations have at least one of the following features:

a length L5 of 1 to 10 mm, optionally 1 to 5 mm;

a number N from 4 to 36, optionally from 6 to 24;

a width L3 of 2 to 4.5 mm, optionally 2.5 to 3.5 mm;

a radius R5 of 2 to 4 mm;

a radius R6 of 1 to 3 mm;

a length L5 of 1 to 10 mm;

a radius R7 of 0.5 to 4 mm; and/or a radius R8 of 0.5 to 20 mm.

9. The method for manufacturing a beverage can according to claim 1, comprising:

providing an aluminium alloy, optionally AA3104, optionally in the metallurgical state H14 or H19, in the shape of a strip with a thickness of 180 to 230 μm, optionally 190 to 220 μm;

cutting one or more discs comprising one or more blanks in the aluminium alloy strip;

stamping and stretching the blanks to obtain a beverage can body, using tools adapted to form the beverage can;

making a cover with another aluminium alloy, optionally AA5182;

assembling the cover and a body of the beverage can to obtain a beverage can.

10. The beverage can according to claim 1, wherein the thickness of the dome sheet is 190 to 220 μm.

11. The beverage can according to claim 1, wherein the outer diameter D3 of the concave dome is 37 to 43 mm.

12. The beverage can according to claim 1, wherein the width of the lower ring L4 is 3.3 to 4 mm.

13. The beverage can according to claim 2, wherein the outer diameter D1 of the body of the beverage can is 55 to 70 mm.

14. The beverage can according to claim 3, wherein the diameter D2 of the lower ring is 40 to 46 mm.

15. The beverage can according to claim 3, wherein the depth H1 is 8 to 11 mm.

16. The beverage can according to claim 3, wherein the rectilinear part of height H3 is from 1.5 to 4 mm.

17. The beverage can according to claim 5, wherein the height H2 is 6 to 14 mm.

18. The beverage can according to claim 5, wherein the height H4 of the beginning of the rectilinear section is 1.5 to 3.5 mm.

* * * * *